US005511259A

United States Patent [19]

Tarara

[11] Patent Number: 5,511,259

[45] Date of Patent: Apr. 30, 1996

[54] CANOPY FOR STRETCHER

[76] Inventor: Joseph R. Tarara, 266 Orchard St., Millis, Mass. 02054

[21] Appl. No.: 389,302

[22] Filed: Feb. 16, 1995

[51] Int. Cl.[6] ..... A47C 29/00

[52] U.S. Cl. ..... 5/414; 5/600; 5/629; 135/133; 135/147; 297/184.17

[58] Field of Search ..... 5/629, 600, 81.1, 5/86.1, 625, 626, 414, 656, 658, 113; 135/133, 147, 148, 152, 153; 297/184.11, 184.17, 184.12, 184.15, 184.1

[56] References Cited

U.S. PATENT DOCUMENTS

| | | | |
|---|---|---|---|
| 1,702,010 | 2/1929 | Klever | 5/81.1 |
| 2,932,833 | 4/1960 | Wambach | 135/133 |
| 3,241,160 | 3/1966 | Escobar | 5/656 |
| 3,651,847 | 3/1972 | Casamassima | 5/644 |
| 5,007,674 | 4/1991 | Franc | 5/414 |
| 5,301,975 | 4/1994 | Rivera | 297/184.15 |

FOREIGN PATENT DOCUMENTS

| | | | |
|---|---|---|---|
| 490479 | 2/1954 | Italy | 5/626 |

*Primary Examiner*—Alexander Grosz
*Attorney, Agent, or Firm*—William Nitkin

[57] ABSTRACT

A collapsible canopy structure for attachment to a stretcher, such canopy having non-transparent first and second side panels and a transparent central panel, such side panels affording privacy to an individual being transported on the stretcher while at the same time medical personnel can view such individual through the transparent central panel of the canopy.

3 Claims, 2 Drawing Sheets

CANOPY FOR STRETCHER

BACKGROUND OF THE INVENTION

1.Field of the Invention

The device of this invention resides in the area of canopies and more particularly relates to a canopy to be attached to a stretcher to provide privacy and protection from inclement weather for an individual being transported on a stretcher from one location to another.

2. Description of the Prior Art

Currently multi-level, lift-in stretchers are frequently used in ambulances and in routine and emergency situations to transport an injured or ill individual. The individual is placed on the stretcher and wheeled or carried from the scene of an accident or other location to an ambulance and from the ambulance into a hospital. Frequently privacy concerns arise for individuals on such stretchers as they do not wish to be gawked at by strangers, and they experience feelings of embarrassment when moved on a stretcher in front of the general public. Often to overcome this problem, one of the emergency personnel will, if requested, place a towel over the individual's face so that the individual's face cannot be seen. At present where is no device available for attachment to a stretcher that emergency personnel can use to preserve the privacy of an individual being moved on a stretcher or to protect his face from rain, snow or hail while the individual is being transported in a supine or sitting position.

SUMMARY OF THE INVENTION

It is an object of this invention to provide a new canopy structure for use on all stretchers to give privacy and protection to an individual being moved from one location to another on a stretcher. The structure of this invention is a downwardly foldable canopy having non-transparent side panels and a transparent central panel to enable medical personnel to view the individual through such transparent panel to be aware of his condition during transport yet assuring privacy to the individual being transported from onlookers as well as from the press at accident scenes. The canopy is collapsible to a lower, out-of-the-way position when not in use. The canopy can be removably attached to existing stretchers by Velcro attachment means or equivalent means of attachment. The installation of the canopy of this invention to a stretcher does not require any modification to the structure of existing stretchers, scoops, portables, backboards and firemen's baskets.

It is a further object of this invention to provide protection from inclement weather for the individual being transported on a stretcher as well as from environmental hazards such as bushes, tree branches and the like encountered when moving an individual on a stretcher through wooded areas such as from an airplane crash scene to a waiting ambulance.

DESCRIPTION OF THE PREFERRED EMBODIMENT(S)

Figure 1:
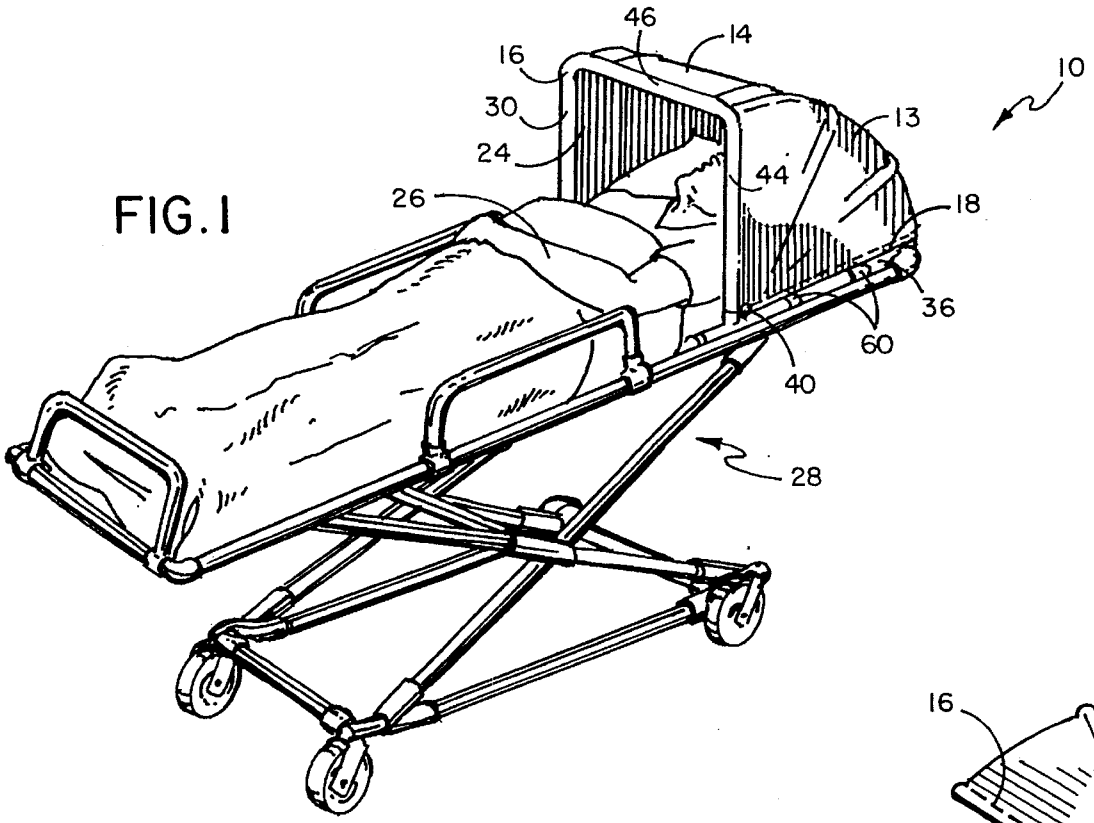
FIG. 1 illustrates a perspective view of the canopy of this invention mounted in its use mode on a stretcher transporting an individual.
Figure 2:
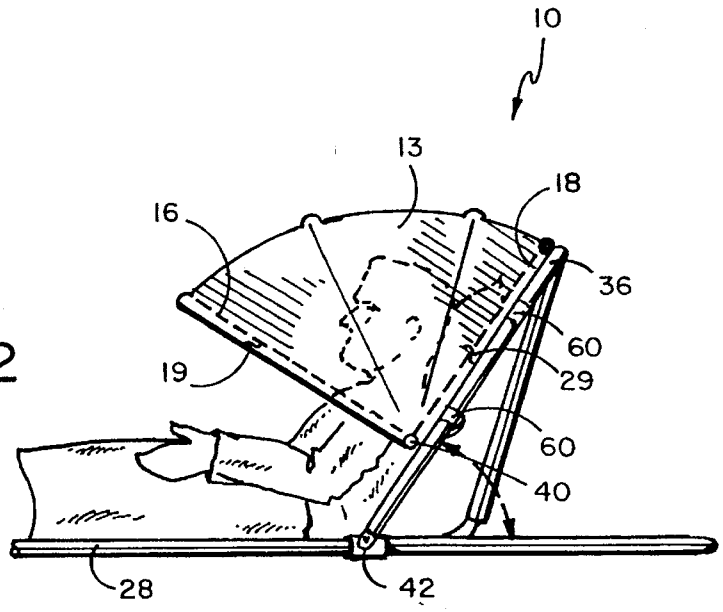
FIG. 2 illustrates a side view of an enlarged section of the canopy of FIG. 1 with the individual being transported in an upright sitting position on the stretcher.
Figure 5:
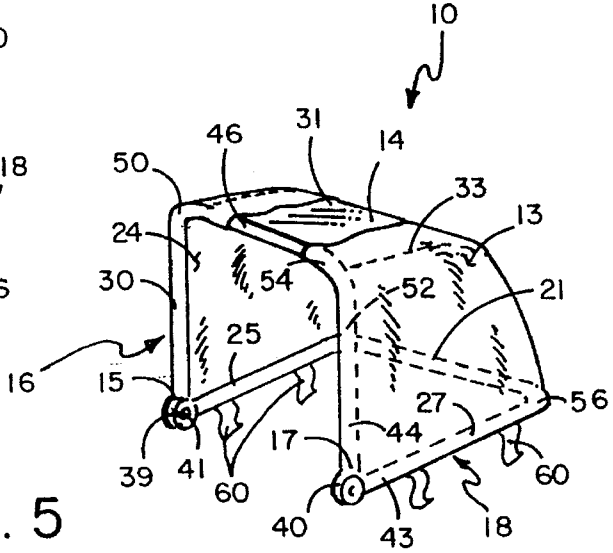
FIG. 5 illustrates a perspective view of the canopy of this invention in its upright, unfolded position not attached to a stretcher.

FIG. 1 illustrates canopy 10 of this invention seen attached to foldable stretcher 28 which stretchers are well known in the art. In this view the head of individual 26 is covered by canopy 10. Canopy 10 has first and second U-shaped members 16 and 18 each of which can be of unitary construction of sturdy material which members are hingeably attached to one another and are maintained in a substantially perpendicular relationship to one another when in use by the tension of first and second hinge members 39 and 40, as seen in FIG. 5. First U-shaped member 16 is formed of first and second arm members 30 and 44, each having first and second ends which are, respectively, connected at their second ends to top cross member 46 at first junction point 50 and third junction point 54. Second U-shaped member 18 is formed of first and second arm members 25 and 27, each having first and second ends as seen in FIG. 5, which are, respectively, connected at their second ends to bottom cross member 21 at second Junction point 52 and fourth junction point 56. First ends 15 and 17, respectively, of first and second arms 30 and 44 of first U-shaped member 16 are free ends which are pivotally and hingeably attached, respectively, to free first ends 41 and 43, respectively, of first and second arm members 25 and 27 by first tightenable hinge member 39 and second tightenable hinge member 40, respectively. The covering of canopy 10 can be affixed to first and second U-shaped members 16 and 18 by glue or equivalent means of attachment, or the U-shaped members can be disposed within first and second sleeve members 19 and 29 formed in the material of canopy 10 as seen in FIG. 2. First and second U-shaped members 16 and 18 can be elongated members, either solid or tubular, made of sturdy material such as plastic, wood, aluminum or other metal.

Figure 3:
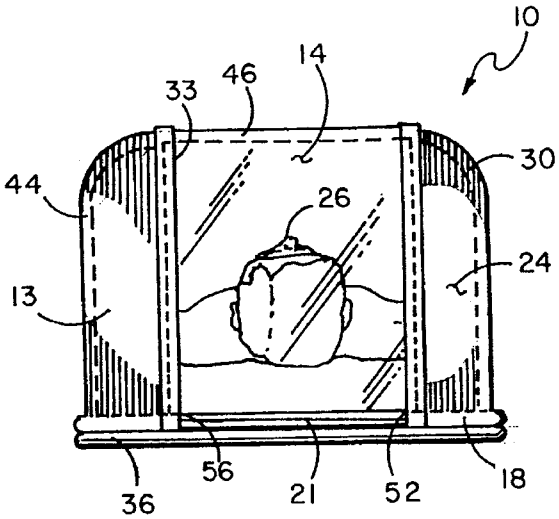
FIG. 3 illustrates a rear view of the canopy attached to a stretcher showing an individual being transported thereon.

In one embodiment of the canopy of this invention, as seen in FIG. 5, the portion of the canopy covering bounded by first arm member 30 of first U-shaped member 16 and first arm member 25 of second U-shaped member 18 and the junction fine 31 joining first and second junction points 50 and 52 defines the position and shape of first side panel 24. The portion of the canopy covering bounded by second arm member 44 of first U-shaped member 16 and second arm member 27 of second U-shaped member 18 and by second junction line 33 joining third and fourth junction points 54 and 56 defines the position and general shape of second side panel. 13. The shape of the side panels can vary. For example, if first and second junction lines 31 and 33 are straight lines, the side panels will be triangular-shaped; if the first and second junction lines 31 and 33 are curved, as seen by dashed lines in FIG. 5, the side panels will be substantially pie-shaped segments. First and second side panels 24 and 13 can be composed of flexible, non-transparent opaque material such as fabric, plastic or equivalent foldable material to prevent viewing by onlookers of the face of the individual being transported on the stretcher. In a preferred embodiment first and third junction points 50 and 54 can be disposed, respectively, in the vicinity of the junctions of the top cross member 46 with first arm member 30 and second arm member 44. Similarly, second and fourth junction points 52 and 56 can be disposed, respectively, in the vicinity of the junctions of bottom cross member 21 with first arm member 25 and second arm member 27. In other embodiments of the canopy of this invention first and third junction points 50 and 54 can be disposed somewhat inward of the arm members along top cross member 46 of first U-shaped member 16, and second and fourth junction points 52 and 56 can be disposed somewhat inward of the arm members along bottom cross member 21 of second U-shaped member 18, as desired, to block viewing of the individual sufficiently to accomplish the goals of this invention. In FIG. 3 second and fourth junction points 52 and 56 are seen disposed on bottom cross member 21.

As partially seen in FIGS. 1, 3 and 5, the portion of the canopy covering circumscribed by the joining of the following lines in turn defines central panel 14: first junction line 31 joining first junction point 50 to second junction point 52, the line joining second junction point 52 to fourth junction point 56, second junction line 33 Joining fourth junction point 56 to third junction point 54, and the line joining third junction point 54 to first junction point 50. In one embodiment, as seen in FIG. 3, central panel 14 can be composed of a flexible transparent material and is attached to first and second side panels 24 and 13, respectively, along first and second junction lines 31 and 33 by means of stitching, glue or equivalent attachment means. In other embodiments, not shown, central panel 14 can be composed of a flexible, non-transparent material and have a smaller viewing area defined within central panel 14 composed of a flexible transparent material of any desired shape sufficient to allow viewing from above of the individual being transported from both the side and the rear by medical personnel.

Figure 4:
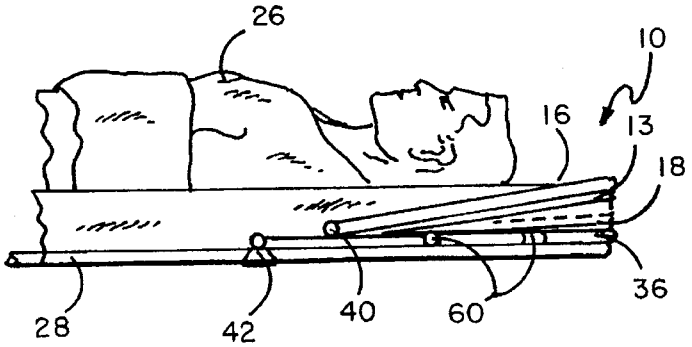
FIG. 4 illustrates a side view of the canopy in its collapsed, non-use mode attached to a stretcher.

As seen in FIGS. 1, 2 and 4 canopy 10 can be removably attached to opposite sides of U-shaped stretcher member 36 of stretcher 28 by attachment means such as plurality of tabs 60 extending from the canopy around the periphery of second U-shaped member 18 which tabs can extend around stretcher member 36 and can be reattached to themselves or to the canopy by Velcro strips, snaps, buckles, buttons or equivalent means. The canopy, being light in weight, can be quickly and easily removed from one stretcher and attached to another, as desired. FIG. 5 illustrates a perspective view of canopy 10 before attachment to a stretcher.

FIG. 2 illustrates an individual being transported on stretcher 28 in a sitting position with U-shaped stretcher member 36 pivoted on stretcher pivot 42. As illustrated, second side panel 13 of canopy 10 provides privacy to the individual from his left side during transport.

FIG. 4 illustrates canopy 10 in its collapsed, non-use mode with first U-shaped member 16 rotated downward to its resting position on second U-shaped member 18 which, in turn, rests on stretcher member 36 of stretcher 28 which stretcher is only partially illustrated.

Although the present invention has been described with reference to particular embodiments, it will be apparent to those skilled in the art that variations and modifications can be substituted therefor without departing from the principles and spirit of the invention.

I claim:

1. In combination, a canopy structure for removable attachment to a stretcher, further including:

a first U-shaped member having first and second arm members and a top cross member having a first end and a second end, said top cross member disposed between said first and second arm members, said first arm member having a first free end and a second end, said second arm member having a first free end and a second end, said second ends of said first and second arm members each connected, respectively, to said first and second ends of said top cross member, said junctions of said second ends of said first and second arm members with said first and second ends of said top cross member defining, respectively, a first junction point and a third junction point;

a first hinge member and a second hinge member;

a second U-shaped member having first and second arm members and a bottom cross member having a first end and a second end, said bottom cross member disposed between said first and second arm members, said first arm member having a first free end and a second end, said second arm member having a first free end and a second end, said second ends of said first and second arm members each connected, respectively, to said first and second ends of said bottom cross members, said junctions of said second ends of said first and second arm member with said first and second ends of said bottom cross member defining, respectively, a second junction point and a fourth junction point, said first free ends of said first arm members of said first and second arm members rotatably and hingeably attached together by said first hinge member, said first free ends of said second arm members of said first and second arm members rotatably and hingeably attached together by said second hinge member, said first U-shaped member rotatable to an upright position substantially perpendicular to said second U-shaped member when in its use mode and rotatable to a downward position substantially parallel to said second U-shaped member in its folded, non-use mode;

a canopy covering attached to said first and second U-shaped members having:

a first side panel defined as the portion of said canopy covering circumscribed by said first arm member of said first U-shaped member, a junction line between said first junction point and said second junction point, and said first arm member of said second U-shaped member, said first side panel being made of non-transparent material;

a second side panel defined as the portion of said canopy covering circumscribed by said second arm member of said first U-shaped member, a junction line between said third Junction point and said fourth junction point, and said second arm member of said second U-shaped member, said second side panel being made of non-transparent material;

a central panel defined as the portion of said canopy covering circumscribed by a line joining said first junction point to said second junction point, a line joining said second junction point to said fourth junction point, a line joining said fourth junction point to said third junction point, and a line joining said third junction point to said first junction point, said central panel being made of transparent material; and means to removably attach said canopy structure to said stretcher.

2. The canopy structure of claim 1 wherein said junction line joining said first junction point to said third junction point is curved; and wherein said junction line Joining said third junction point to said fourth junction point is curved.

3. The canopy structure of claim 1 wherein said first side panel extends to points inward from said first junction point and said second junction point, respectively, along said top cross member and bottom cross member; and wherein said second side panel extends to points inward from said third junction point and said fourth junction point, respectively, along said top cross member and bottom cross member.

* * * * *